US006662963B1

(12) United States Patent
Meike et al.

(10) Patent No.: US 6,662,963 B1
(45) Date of Patent: Dec. 16, 2003

(54) VESSEL

(75) Inventors: Klaus Meike, Wilnsdorf (DE); Hans H. Reichmann, Burbach (DE)

(73) Assignee: Schäfer Werke GmbH, Neunkirchen (DE)

( * ) Notice: Subject to any disclaimer, the term of this patent is extended or adjusted under 35 U.S.C. 154(b) by 284 days.

(21) Appl. No.: 09/397,688

(22) Filed: Sep. 16, 1999

(30) Foreign Application Priority Data

Sep. 18, 1998 (DE) ..... 298 16 750 U

(51) Int. Cl.[7] ..... B65D 25/24
(52) U.S. Cl. ..... 220/634; 220/632; 206/821
(58) Field of Search ..... 220/634, 632, 220/649; 206/821

(56) References Cited

U.S. PATENT DOCUMENTS 3,349,940 A * 10/1967 Cornelius ..... 220/632
3,840,141 A * 10/1974 Allom et al. ..... 220/634
4,573,603 A * 3/1986 Starling et al. ..... 220/632

FOREIGN PATENT DOCUMENTS

| | | | | |
|---|---|---|---|---|
| DE | 2844812 | * | 4/1980 | ..... 220/649 |
| DE | 3937085 | * | 5/1990 | ..... 220/632 |
| GB | 1127305 | * | 9/1968 | ..... 220/649 |
| GB | 2001032 A | * | 1/1979 | ..... 220/632 |
| JP | 614817 A1 | * | 9/1994 | ..... 220/632 |

* cited by examiner

*Primary Examiner*—Mickey Yu
*Assistant Examiner*—Troy Arnold
(74) *Attorney, Agent, or Firm*—Sidley Austin Brown & Wood, LLP

(57) ABSTRACT

A vessel including a vessel body formed of metal and having an approximately cylindrical wall, a bottom and a cover, and a plastic ring provided at each of opposite ends of the vessel body and extending radially beyond the vessel body, with at least one of the plastic rings including a flange ring, a shaped ring which abuts a section of the vessel body, and an intermediate ring which connects the flange ring with the shaped ring and has a neck portion.

13 Claims, 1 Drawing Sheet

VESSEL

BACKGROUND OF THE INVENTION

1. Field of the Invention

The present invention relates to a vessel having a vessel body formed of metal and including an approximately cylindrical wall, a bottom and a cover, and a plastic ring provided at each of opposite ends of the vessel body and extending radially beyond the vessel body.

2. Description of the Prior Art

Such vessels, which are used, e.g., for receiving beverages, have a body formed of a special steel and generally well known. A vessel of this type is described, e.g., in a British Publication GB-A-2,001,032. In the vessel described in the British Publication, both the base and the top rings are formed as massive, plastic rings and are rather expensive. One of the rings (the base ring) serves for supporting the vessel, with the other ring insuring convenient handling of the vessel, being provided to this end with a gripping opening. On the other hand, the two rings serve for protecting the vessel body from deformation. The danger of the deformation of the vessel body is particularly large when during loading or transportation of the vessels, the vessel is displaced downwardly along a loading platform in an inclined position and is, therefore, subject to a one-sided shock load. The forces, which in this case act on the vessel, are so large that they crash the vessel body because of the deformation of the respective ring, and the vessel becomes unusable as the vessel volume is not insured. The used plastic rings are not capable of withstanding or absorbing the acting forces and transmit them, as a result of their deformation, directly to the vessel body.

A high resistance of the vessel body to the deformation is achieved in the vessel disclosed in German Publication DE-A-39 37 085. In the vessel described in the German Publication bottom-side and cover-side rings or rims are formed of a polymer material, and metallic parts are secured at the vessel body ends. The metallic additional parts have at least one connection surface formed as a ring to which a tooth plate is attached the teeth of which are so inclined toward the ring that the teeth ends extend toward the bottom or the cover and are attached to the bottom or the cover. This variation of a vessel is characterized by a large expenditure of material and by high manufacturing costs. In addition, gaps are formed at the free ends of the metallic parts which create, in case of dirt accumulation, a danger of gap corrosion under action of moisture.

Accordingly, an object of the present invention is to provide a vessel of the above-described type devoid of the above-discussed drawbacks.

Another object of the present invention is to provide a vessel of the above-described type which insures an improved protection of the vessel body from deformation in case of a fall and/or when the vessel is subjected to a shock load.

A further object of the present invention is to provide a vessel of the above-described type which can be easily cleaned and can be economically produced.

SUMMARY OF THE INVENTION

These and other objects of the present invention, which will become apparent hereinafter, are achieved by providing a vessel in which at least one of the plastic rings includes a flange ring, an arc-shaped ring abutting a section of the vessel body, and an intermediate ring which connects the flange ring with the shaped ring and has a reduced size waist-like portion. The present invention proceeds from a premise that the relatively formstable flange region of the vessel body, together with the adjoining ring section, forms a rigid sandwich unit, with the rigid flange ring section, which is connected with the remaining portion of the ring by the intermediate ring section, absorbing the axial or partially axial forces. The fall energy of the vessel is converted into the deformation energy as a result of the elastic deformation of the intermediate and flange rings, which form sections of the respective plastic ring, without the bond of the shaped ring with the vessel body transmitting deformation to the bottom or cover.

In this way, damage of the vessel body is prevented. The bottom ring has a rather compact flange ring, whereas the flange ring of the top ring has an increased length such that the upper edge of the flange ring extends past the inlet nipple, with the height of the tubular extension being such that a gripping opening can be provided, on one hand, and on the other hand, a sufficient surface remains for inscriptions indicating the characteristics of the vessel, ownership, etc. . . . Because the tubular extension provides for an additional increased stability of the flange ring of the top ring, its wall thickness up to its lower edge, which serves as a snap and stop edge, can be reduced, without reducing the capacity of the top ring to absorb the deformation energy. The diameters of the flange ring of the base and top rings and their staggering are so adapted to each other that a reliable stacking of the vessels having the same shape is insured. The reliable stacking is also possible with the vessels having different shapes but the same diameters. The stacking of vessels of different shapes is also possible by formation of shorter ribs on the inner surface of the base ring. In order to optimize application of forces to sections of the base and top rings adjacent to the vessel body, it is proposed to form a transition region between the intermediate ring and the shaped ring which is closest to the vehicle body, as an arcuate region.

Pressure peaks and deformation of the portions of the base and top rings adjacent to the vehicle body, in the region of the bottom and cover caps, which are susceptible to bending, are prevented by having the thickness of the base and top rings reduced in the respective regions of the rings to a minimum, with the rings having in the respective regions an elastic profile. According to advantageous embodiment of the present invention, the base and top rings are formed of a thermoplastic material. This material has good shock and tear resistance, is easily recycled, and, e.g., can be easily colored in different colors. Parts from this material can be easily and economically produced by insection molding. The base and top rings are secured on the vessel body by an elastic snap engagement of the retaining rings, which are provided on the shaped rings, in the grooves formed on the vessel body. In order to achieve a very strong rigidity of the connections, it is further proposed to glue the base and top rings to the vessel body.

In accordance with a further development of the present invention, the top ring is provided with a pocket, which is easily deformable in the axial direction for snap pin connection with a logistic element, e.g., a transponder.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS:

In the Drawings:

Single FIGURE shows a side elevational view of a vessel according to the present invention, with partially cross-sectional view of the base and top rings.

DETAILED DESCRIPTION OF THE PREFERRED EMBODIMENT

Figure 1:
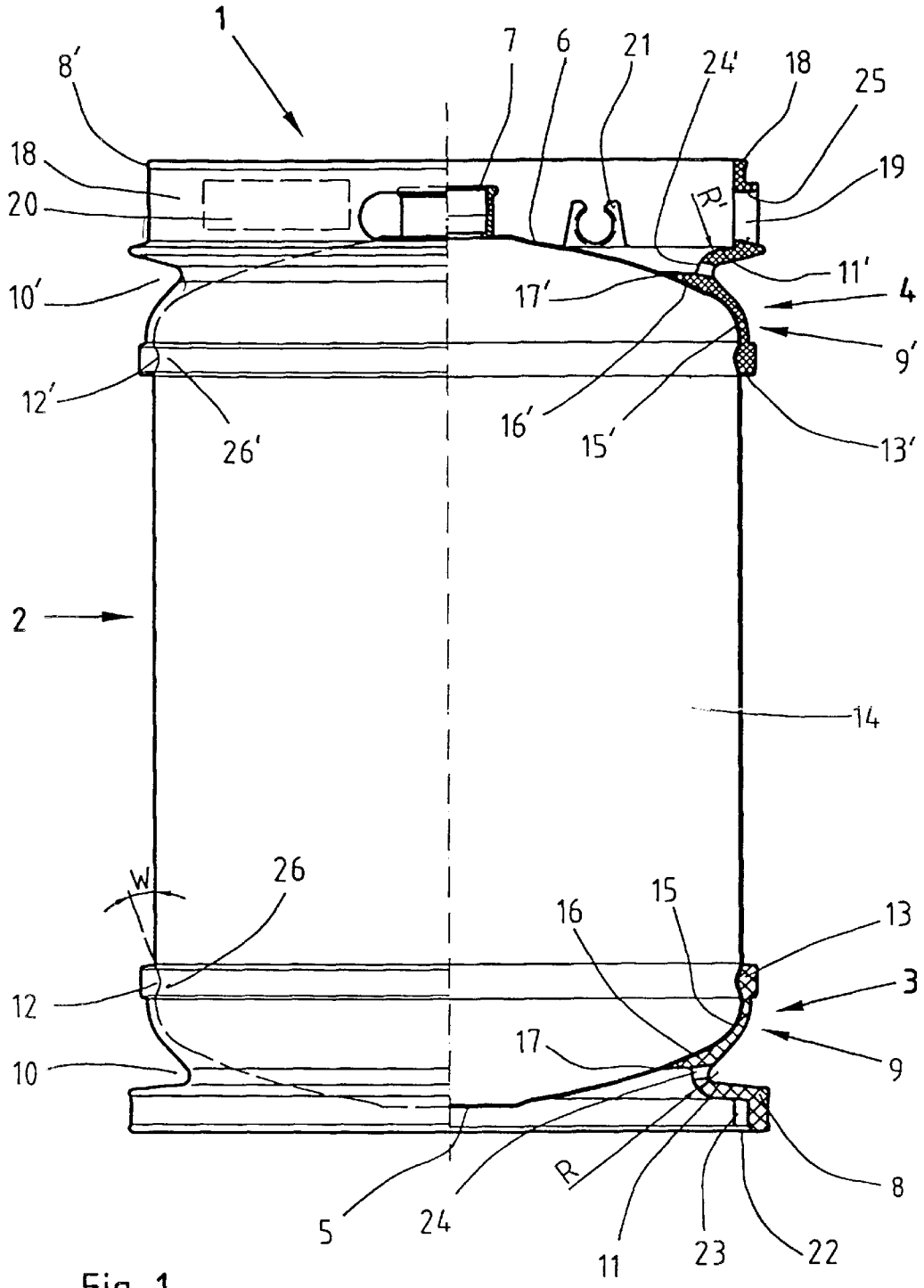

A vessel according to the present invention, which is generally designated with a reference numeral 1, is generally formed of a vessel body 2, a bottom-side base ring 3 and a cover-side top ring 4. The vessel body 2 has an approximately cylindrical wall 14, an outwardly bulging bottom 5, and a cover 6 with an inlet nipple 7. Two inwardly extending grooves 12, 12' are formed in the outer surface of the wall 13 at a small distance from the transition regions between the wall 14 and the bottom 5 and the cover 6, respectively. The grooves 12, 12' have inwardly inclined surfaces 26,26', respectively, which extent at an angle W to the outer surface of the wall 14. The grooves 12,12' have a depth such that on one hand, it does not adversely affect inner washing of the container by changing the laminar fluid flow to the turbulent flow and, on the other hand, enables a reliable snap engagement of retaining rings 13, 13' of the base and top rings 4, 5, respectively, in the respective grooves, 12, 12'.

The base and top rings 3 and 4 include each, respectively, a flange ring 8,8', a arc-shaped ring 9,9' which abuts a respective section of the vessel body 2, and an intermediate ring 11,11' which connects the flange ring 8,8' with the arc-shaped ring 9,9'. Because the connection point between the intermediate ring 11,11 ' and the arc-shaped ring 9,9' has a smaller diameter than the connection point of the intermediate ring 11,11 with the flange ring 8,8', a waist-like 10,10' section is formed in the base and top rings 3 and 4 in the region of the connection point of t intermediate ring 11,11' with the arc-shaped ring 9,9', respectively.

Advantageously, the transitional region between-the intermediate ring 11,11' and the arc-shape ring 9,9' is formed as an accurate transitional region R,R', and the intermediate ring 11,11' has a vertruncated jointed conical surface. The above-described shape favorably influences the deformation conditions and draining of the washing fluid.

The arc-shaped ring 9,9' includes the entire curved region of the bottom 5 and the cover 6, respectively, with the retaining ring 13,13' being formed at the edge of the arc-shaped ring 9,9' adjacent to the vessel wall 2. The retaining ring 13,13' has a larger thickness than the arc-shaped ring 9,9' and, therefore, a greater rigidity. The shaped ring 9,9' has, at its inner edge 17,17', adjacent to the bottom 5 or cover 6, respectively, a section 16,16', the thickness of which diminishes toward the inner edge 17,17'. The arcuate section 15,15', which is located between the retaining ring 13,13' and the section 16,16', has approximately the same thickness, which increases toward the transition region R,R' between the arc-shaped ring 9,9' and the intermediate ring 11,11'.

The end surface of the flange ring 8 is provided with a stacking step 22, with an axial stepping surface being formed substantially by ribs 23 provided on the inner surface of the flange ring 8.

The top ring 4 differs from the base ring 3 in that the flange ring 8' is provided with a tubular extension, with the initial thickness being retained only at the connection point of the flange ring 8' with the intermediate ring 11'. As a result, a drum-like projection is formed which extends past the vessel body 2. The remaining portion 18 of the tubular extension has a reduced thickness and a length projecting above the inlet nipple 8. The flange ring 8' of the top ring 4 is provided with a handling opening 19 and a marking surface 20. The handling opening 19 is provided with an outer edge reinforcement 25.

The outer diameters of flange ring 8' and of the stacking step 22 of the flange ring 8 correspond to each other, which insures a simple and reliable stacking of the vessels.

Finally, there is provided, on the inner side of the tubular flange ring 8', a receiving pocket 21 which is adapted for a snap connection, e.g., with a transponder.

The base ring 3 and the top ring 4 are provided, in the regions of the connection points of the intermediate rings 11,11' with the arc-shaped rings 9,9', respectively, with at least one through-opening 24,24', respectively, for draining the washing liquid.

Though the present invention has been shown and described with reference to a preferred embodiment, such is merely illustrative of the present invention and is not to be construed as a limitation thereof, and the present invention includes all modifications, variations and/or alternate embodiments within the spirit and scope of the present invention as defined by the appended claims.

What is claimed is:

1. A vessel, comprising a vessel body formed of metal and having an approximately cylindrical wall, a bottom and a cover; and a plastic ring provided at each of opposite ends of the vessel body and extending radially beyond the vessel body, wherein at least one of the plastic rings includes a flange ring, an arc-shaped ring which abuts a section of the vessel body, and an intermediate ring which connects the flange ring with the arc-shaped ring and has a reduced diameter waist-like portion, wherein the arc-shaped ring comprises a retaining ring engageable in an associated circular groove formed in, the vessel body, a curved section encompassing a transition region between the wall of the vessel body and one of the bottom and the cover, and a section extending past a connection point of the arc-shaped ring with the intermediate ring and toward a center of the one of the bottom and the cover, and wherein the section, which extends past the connection point of the arc-shaped ring with the intermediate ring, has a thickness which constantly decreases from the connection point to an inner edge of this section.

2. A vessel as set forth in claim 1, wherein at least a transition region between the intermediate and shaped rings is arcuate-shaped.

3. A vessel as set forth in claim 1, wherein the at least one of the plastic rings is a base ring, and wherein a inner side of the flange ring is provided with ribs defining a stacking step.

4. A vessel as set forth in claim 1, wherein the at least one of the plastic rings is a top ring, and wherein the flange ring has a tubular extension having a portion spaced from a connection point of the flange ring with the intermediate ring and having a reduced thickness.

5. A vessel as set forth in claim 4, wherein the tubular extension is provided with a gripping opening and marking surface.

6. A vessel as set forth in claim 4, wherein the tubular extension has a pocket for receiving a transponder.

7. A vessel as set forth in claim 6, wherein the associated circular groove is provided behind a transition region between the wall and the one of the bottom and the cover and has an inclined surface.

8. A vessel as set forth in claim 7, wherein the inclined surface forms with an outer surface of the wall an angle of maximum 20°.

9. A vessel as set forth in claim 1, wherein both plastic rings are formed of a thermoplastic material.

10. A vessel as set forth in claim 9, wherein the thermoplastic material has a microfoam structure.

11. A vessel as set forth in claim 9, wherein both plastic rings have the same color.

12. A vessel as set forth in claim 1, wherein the shaped ring is glued to the vessel body wall.

13. A vessel as set forth in claim 1, wherein the intermediate ring has an arcuate portion provided with a through-opening for draining liquid.

* * * * *